US006497769B1

(12) United States Patent
Martin

(10) Patent No.: US 6,497,769 B1
(45) Date of Patent: Dec. 24, 2002

(54) RADIOACTIVE DECONTAMINATION AND TRANSLOCATION METHOD

(75) Inventor: Robert T. Martin, Delta, UT (US)

(73) Assignee: Bobolink, Inc., Delta, UT (US)

( * ) Notice: Subject to any disclaimer, the term of this patent is extended or adjusted under 35 U.S.C. 154(b) by 0 days.

(21) Appl. No.: 09/976,467

(22) Filed: Oct. 12, 2001

(51) Int. Cl.[7] ..... B08B 3/04

(52) U.S. Cl. ..... 134/10; 134/2; 134/3; 134/26; 134/28; 134/22.19; 134/41; 134/42; 510/110; 376/308; 376/309; 376/310; 423/2; 423/3; 423/20; 588/1; 588/20; 210/682; 210/688; 976/DIG. 376; 976/DIG. 391

(58) Field of Search ..... 134/2, 3, 10, 26, 134/28, 36, 41, 42, 22.19; 510/110; 376/308, 309, 310; 423/2, 3, 20; 588/1, 20; 210/682, 688; 976/DIG. 376, DIG. 391

(56) References Cited

U.S. PATENT DOCUMENTS

| | | | | |
|---|---|---|---|---|
| 4,729,855 A | | 3/1988 | Murray et al. | 252/626 |
| 5,049,297 A | * | 9/1991 | Morris et al. | 134/22.13 |
| 5,200,117 A | * | 4/1993 | Morris et al. | 134/22.11 |
| 5,322,644 A | | 6/1994 | Dunn et al. | 252/626 |
| 5,434,331 A | | 7/1995 | Barkatt et al. | 588/1 |
| 5,545,794 A | | 8/1996 | Bray | 588/1 |
| 5,591,270 A | | 1/1997 | D'Muhala | 134/3 |
| 5,613,239 A | | 3/1997 | Obinata et al. | 588/1 |
| 5,678,232 A | | 10/1997 | D'Muhala | 588/1 |
| 5,824,159 A | * | 10/1998 | Tate | 134/10 |
| 5,833,395 A | | 11/1998 | Fletcher et al. | 405/128 |
| 5,852,786 A | | 12/1998 | Bradbury et al. | 588/1 |

FOREIGN PATENT DOCUMENTS

| | | | |
|---|---|---|---|
| GB | 2065092 A | * | 12/1979 |
| JP | 357111244 A | * | 7/1982 |
| JP | 11202086 A | * | 7/1999 |

* cited by examiner

*Primary Examiner*—Sharidan Carrillo
(74) *Attorney, Agent, or Firm*—Thorpe North and Western

(57) ABSTRACT

A method for removing radioactive contaminants from a given surface. An acidic solution having a pH of less than 3.0, and preferably less than 1.5, of a complex substituted keto-amine, and a mixture of a saturated and unsaturated lower alcohol (e.g. isopropyl alcohol and propargyl alcohol), and concentrated acid is applied to a contaminated surface. The solution is left on said surface for a time sufficient to remove the radioactive contaminants into the acidic solution and then removed. The acidic solution containing the radioactive contaminants is preferably neuralized by an alkaline material to a pH of between 5.5 and 9.0. Removal of thorium contamination from railcars is one useful application of the invention. The method of the present invention has the effect of removing substantially all of the radioactive contaminants from a previously contaminated surface.

19 Claims, No Drawings

RADIOACTIVE DECONTAMINATION AND TRANSLOCATION METHOD

BACKGROUND OF THE INVENTION

The present invention relates generally to a method for decontamination of surfaces. More particularly, the present invention relates to using an acidic solution to remove radioactive contaminants from a given area, location or surface.

Contamination of various areas or surfaces from radioactive or other unwanted materials is a common problem. The contamination of an area or surface may occur as a result of contact with a radioactive isotope during transport, storage, use in a nuclear reactor, mining operations, or a variety of other industrial or military processes. In recent years, methods have been explored to reduce or remove such contaminants from various areas or surfaces and equipment so that such items or areas may be put back into use and the contaminants be disposed of safely. These methods have met with varying success and often present trade-offs between decontamination of the surface or area and the toxicity of the waste product containing the radioactive contaminant.

One method of removing radioactive materials is to physically wash the contaminated area or surface with water and an optional surface-active agent. However, such methods are generally limited to physical separation of contaminants that are not physically or chemically adhered to surfaces or areas. Thus, this method does not work well where the contaminants are chemically bound to a solid surface or structure.

For example, a number of methods have been developed to remove radioactive contaminated scale or rust deposits from metal surfaces. The radioactive substances are removed in a solution that is transported at safe levels for disposal. However the concentrated radioactivity found in scale or rust adhering to surfaces presents increased danger and cost in removal and disposal. Depending on the type of scale or rust deposit either acidic or basic treatments may be appropriate. U.S. Pat. Nos. 5,200,117, 5,049,297 and 5,824,159 illustrate typical approaches to removing radioactive substances in these situations.

Another method for removing contaminants from surfaces or areas, which are not necessarily limited to deposited scales, is known generally as acid leaching. In acid leaching methods, a strong acid is used to dissolve radioactive contaminants from the surface into solution. The resulting solution is removed and disposed of leaving a clean, or at least a reduced amount of radioactive contaminants, on the surface. Such acid leaching processes may or may not use chelating agents.

Chelating agents have been the subject of much research in this area and include ligand or binding agents such as oxalate, citrate, gluconate, picolinate, EDTA, hydrazines with a carboxylic acid, and hydroxamic acids. Acidic and basic solutions containing a chelating agent are used to dissolve and bind contaminants depending on the characteristics of the surface and the contaminants. When used to remove radioactive substances from contaminated areas, the chelating agent is thought to have the effect of stabilizing certain dissolved radioactive contaminants to keep them in solution. Several of these methods use concentrated carbonate solutions to recover uranium, thorium, radium, technetium, and other actinides.

With several of these methods, a separate ion-exchange process is used to purify the resulting solution to make disposal of the radioactive contaminants easier.

In addition n to these challenges, other considerations include providing a decontaminating agent and method which is not excessively corrosive and is easy to prepare and use. Further, the solution containing removed contaminants should preferably be easily disposed of in compliance with state and federal regulations. It would therefore be a significant advancement and contribution to the art to provide a method which is a simple, economic, and an effective way of removing substantially all of radioactive contaminants from various surfaces or areas.

SUMMARY OF THE INVENTION

While many methods for removing radioactive or other unwanted contaminants have been developed there remains the need for improved decontamination methods which speed up the decontamination process and remove substantially all of the radioactive contaminants.

The present invention relates to the removal of radioactive contaminants from a surface or area using a highly acidic solution which includes a complex substituted keto-amine The present invention provides a method for removing radioactive contaminants from a surface or area comprising the steps of: forming a solution containing a complex substituted keto-amine, a mixture of saturated and unsaturated lower alkanols, e.g. isopropyl alcohol and propargyl alcohol, and a concentrated acid or acid mixture to form an acidic solution; applying the keto-amine, lower alkanol mixture and acidic solution in such a manner as to contact the contaminants on the surface or in the area such that at least a portion of such radioactive or other contaminants migrate into the acidic solution; collecting the contaminant rich acidic solution for further treatment or disposal.

In accordance with a more detailed aspect of the present invention, the concentrated acid is selected from strong acids consisting of the group hydrochloric acid, hydrofluoric acid, sulfuric acid, phosphoric acid, sulfurous acid, bromic acid, iodic acid, nitric acid, perchloric acid, oxalic acid, aqua regia (nitrohydrochloric acid) and mixtures thereof. In a more detailed aspect, the resulting acidic solution using one of the above acids has a pH of less than 1.5.

In accordance with yet another more detailed aspect of the present invention, the method is used to remove radioactive contaminants, and particularly those found in the actinide and lanthanide series such as thorium, uranium, and plutonium. Exemplary of radioactive contaminants, some of which are in the actinide and lanthanide series, are Actinium-227, Americium-241, Americium-243, Antimony-124, Antimony-125, Barium-133, Beryllium-7, Bismuth-207, Cadmium-109, Calcium-45, Carbon-14, Cerium-139, Cerium-141, Cerium-144, Cesium-134, Cesium-135, Cesium-137, Chromium-51, Cobalt-56, Cobalt-57, Cobalt-58, Cobalt-60, Copper-67, Curium-242, Curium-243, Curium-244, Curium-247, Europium-152, Europium-154, Europium-155, Gadolinium-153, Germanium-68, Gold-195, Hafnium-181, Hydrogen-3(Tritium), Iodine-125, Iodine-126, Iodine-129, Iodine-131, Iodine-133, Iridium-192, Iron-55, Iron-59, Lead-210, Manganese-54, Mercury-203, Neptunium-237, Nickel-59, Nickel-63, Niobium-94, Plutonium-236, Plutonium-238, Plutonium-239, Plutonium-240, Plutonium-241, Plutonium-242, Plutonium-243, Plutonium-244, Polonium-210, Potassium-40, Promethium-147, Protactinium-23 1, Radium-223, Radium-224, Radium-226, Radium-228, Ruthenium-106, Samarium-151, Scandium-46, Selenium-75, Silver-108 m, Silver-110 m, Sodium-22, Strontium-85, Strontium-89, Strontium-90, Sulfur-35, Tanalum-182, Technetium-99, Thallium-204, Thorium-natural, Thorium-228, Thorium-230, Thorium-232, Tin-i13, Uranium-232, Uranium-233, Uranium-234, Uranium-235, Uranium-236, Uranium-238, Uranium-natural, Uranium-depleted, Yttrium-88, Yttrium-91, Zinc-65, Zirconium-95 and associated decay products thereof.

By "surface" or "area" is meant the presence of a contaminant on or about a surface or area that may include solid structures, such as trucks, equipment, and the like, particulate, compressible or linear solids such as soils, wires, gauzes, steel wool and the like. "Area" may also be used to define a location which may be inclusive of liquids such found in ponds, tanks, open or enclosed containers and is inclusive of such containers. In most instances, all contaminants will be associated in, on, attached to, embedded in or associated with a solid having a surface area.

In accordance with another aspect of the present invention, the method is applied to a solid surface or area as defined above which comprises metal, plastic, glass, concrete, wood, soil, or any other material.

In general, the method comprises applying the acid solution, as hereinafter defined, in such a manner as to contact the radioactive contaminant and remove it from the surface or area to which it is associated into the solution. Such application techniques may be by spraying, wiping, soaking, immersing and the like. Once applied to a surface it is important that the solution be removed before the solution dries on the surface. Otherwise, the radioactive contaminant would not be removed. Hence, the time the solution is on the surface may be relatively short or long, depending on the drying time and application process. It may be more efficient to sequentially apply more than one application and removal step to adequately remove the radioactive decontaminant from the surface and the length of time between the application and removal steps may vary from a few seconds to several minutes depending on the condition of the surface and the amount radioactive contaminant to be removed. Any suitable removal technique, such as a squeegee, wiper blade, gravity flow, and the like may be used to remove the solution from the surface.

Finally, in accordance with another aspect of the present invention the collected acidic solution containing the removed radioactive contaminant may be treated to reduce the pH. The collected acidic solution may be treated by adding sodium hydroxide or any other suitable neutralizing agent to obtain a pH of greater than about 5.5, and preferably about 7 to form a waste solution.

Additional features and advantages of the invention will be apparent from the detailed description which follows.

DETAILED DESCRIPTION

For the purposes of promoting an understanding of the principles of the invention, reference will now be made to exemplary embodiments, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

As used herein, "on the surface", "from the surface", "in the area", "from the area" and the like is intended to cover removal of radioactive particles that are on, near, physically attached to, chemically attached to, embedded in or otherwide associated with the solid surface or area. As such, the method of the present invention allows for removing and dissolving any radioactive particles which are susceptible to contact with the decontamination solution regardless of the physical association or location of such particles in connection with such surface. One surface of particular importance is a porous metal surface, i.e. a surface which has been oxidized, e.g., contains rust, to which radioactive particles have become attached or embedded.

As used herein the term "acidic solution" is intended to mean an aqueous acidic solution containing a keto-amine and a mixture of lower alcohols having two to five carbon atoms. One alcohol is saturated and is preferably isopropyl alcohol. The other alcohol is unsaturated and is preferably propargyl alcohol.

As used herein, percentages refer to weight percentages unless otherwise specified. Further, one should note that the term "between" is used herein to identify a range and without the modifier "about" does not include the limit of the identified range. For example, "between 0% and about 3%" includes values ranging from about 3% by weight, as would be understood in the art down to, but not including 0%.

The present invention provides a method for removing radioactive contaminants from a contaminated surface or area. A previously noted a decontamination solution is formed containing a complex substituted keto-amine, and alcohol mixture which is preferably isopropyl alcohol and propargyl alcohol, and concentrated acid. The concentrated acid may be strong a acid such as hydrochloric acid, hydrofluoric acid, sulfuric acid, phosphoric acid, sulfurous acid, bromic acid, iodic acid, nitric acid, perchloric acid, oxalic acid, aqua regia and mixtures of such strong acids. Hydrochloric acid exhibits particularly good results and may be used in a concentrated aqueous solution of about 32% to 38% hydrochloric acid. The currently used concentration for hydrochloric acid is 37% with the balance being water. The complex substituted keto-amine preferably has the molecular formula $C_{33}H_{45}NO_2$. Cl H and may also be identified by the CA Index chemical name 2-Butanone, 4-[[[(1R,4aS, 10aR)-1, 2,3,4,4a,9,10,10a-octahydro-1, 4a-dimethyl-7-(1 -methylethyl)-1-phenanthrenyl]methyl](3-oxo-3-phenylpropyl)amino]-, hydrochloride (9Cl). The aqueous acid solution contains between about 0.1 to 2%, and preferably between about 0.4 to 0.6%, of the complex substituted keto-amine, about 0.1 to 0.5% of the saturated lower alcohol (e.g. isopropanol) and 0.1 to 0.5% of the unsaturated lower alcohol (e.g. propargyl alcohol) with the remainder being the concentrated acid sufficient to provide a pH of 3.0 or below and preferably of 1.5 or below. Other complex substituted keto-amines that are functional for the same purpose may also be utilized.

The contaminated surface may be cleaned and prepared to remove any dirt, oil, dust, or other debris prior to the decontamination. If the surface contains organic materials, such as oils or certain surfactants, it may be preferably to clean the surface with other appropriate materials, solvents or cleaning agents such as acetone, methylethyl ketone, steam, strong surfactants, etc. The use of water and/or steam is acceptable, however the use of surfactants was shown to reduce the effectiveness of the present invention. As noted above, the contaminated surface may be any solid surface which exhibits undesirable levels of radioactive particles such as thorium, uranium, plutonium, and other elements from the actinide and lanthanide series of the periodic table as well as other radioactive substance as previously listed. As also previously noted, such surfaces may include, but are not limited to metals, plastics, glass, wood, concrete, and soil. Transportation equipment such as railcars, trucks, ships, forklifts, containers, pumps, covers and pipes often become radioactively contaminated during transport of waste materials and are particularly subject to being treated according to the present invention. Stationary surfaces such as buildings and process equipment are also often contaminated with radioactive particles. Other materials include polymeric materials, polyethylenes, rubbers, nuclear reactor equipment, spent nuclear fuel rods, and any other equipment or containers which are used in handling, using, processing and transporting radioactive materials. It is to be understood that the above recited lists of various specific surfaces are intended to merely illustrate some of the types of surfaces which may be used in connection with the present invention, and are not intended to limit the scope thereof.

The decontamination solution is then applied to the contaminated surface. The acidic decontamination solution may be applied using any conventional method such as spraying, immersing, brushing, splashing, providing a continuous flow of fresh solution (as through a pipe or over a surface), and any other method which produces direct contact of the decontamination solution with the contaminated surface. Although, a variety of application methods may be used as is known in the art, spraying has produced satisfactory results. Accordingly, the decontamination solution may be placed in a device which is capable of producing a spray and is designed for highly acidic contents. Such spraying devices include without limitation hand spray bottles, lightweight sprayers, and industrial spraying machines (either manual or automated). The temperature of the decontamination solution may be whatever is functional and is preferably ambient temperature of less than 40° C. In other words, the acidic solution does not require heating although that may be done if desired to facilitate radioactive removal.

Application rates and amounts are best determined empirically and are based on the amount or concentration of radioactivity on the contaminated surface, the depth of scale or rust containing the contamination on the surface, the surface area to be treated, whether sequential application and removal is desired, and the like. What is required that that a functional area or surface is treated with the acidic solution and allowed to remain for a time sufficient to remove the radioactive materials that are contacted followed by removal of the contaminant containing solution. The area treated is limited to that which can adequately be treated and the solution removed by the operator. Generally speaking, the solution will remain on the surface for ten minutes or less and will preferably be on the surface for five minutes or less. However, for some operations the solution may remain for periods of twenty minutes or more. It may be preferable to treat the surface with a succession of treatments where the solution is applied and removed followed by sequential treatments of application and removal until the desired result is obtained. It is not the time or amount that is critical as these parameters may be empirically determined. It is the discovery that the acid solution containing the complexed keto-amine and the alcohol combination functions to remove essentially all of the radioactive contamination that is paramount.

One important benefit of this invention is the speed and efficiency of the decontamination process. After treating the surface with the acid solution the solution containing the removed radioactive contaminants may be removed using conventional methods such as vacuuming, using a wiper blade or squeegee, rinsing or any other appropriate means and collected in a separate collection container. As previously mentioned, application times of less than about 5 minutes such as about 2 to 3 minutes have produced good decontamination results. The application and removal process may also be repeated and has the effect of increasing the rate of dissolving the contaminated particles.

After the decontamination solution is removed from the surface further treatment of the surface may be desirable. The resulting surface is often exposed bare metal and as such will oxidize and begin to corrode if left untreated. Treatment with corrosion inhibitors such as phosphoric acid and other known products may improve the long-term corrosion resistance of treated metal surfaces.

In another more detailed aspect of the present invention, the spent solution in the collection container containing the removed radioactive materials is neutralized to a pH of 5.5 or above and preferably about 7.0 by means of aqueous sodium or potassium hydroxides or other alkaline neutralizing agents. In order to increase efficiency the monitoring and addition of alkaline solution is accomplished using automated equipment, although the process could be done manually. An alkaline solution, such as sodium hydroxide or potassium hydroxide is added to the collected solution which contains radioactive contaminants to reach a pH of greater than 5.5. A collected solution having a pH in the range of about 6.5 to 9 makes storage and disposal of the radioactive solution easier and safer.

Conventional means may be used to remove the neutralized contaminated solution to a suitable disposal site in accordance with established regulatory procedures.

EXAMPLES

The following examples are intended to further illustrate certain aspects of the present invention and should not be regarded as limiting the scope of the present invention.

Table 1 shows the results of several experiments using the method of the present invention measured in terms of disintegrations per minute (dpm) before and after treatment. Experiments 1 through 4 used concentrated (37%) HCl containing 0.5% of the above identified complexed keto-amine, 0.2% isopropyl alcohol, and 0.2% propargyl alcohol maintained at a pH below about 1.1. Experiment 5 consisted of only concentrated HCl solution also having a pH of below about 1.1. The results of experiment 5 indicate that the addition of the keto-amine and mixed alcohols had a noticeable effect on the dpm values.

TABLE 1

| Experiment | Decontamination Solution | Start beta (dpm) | Finish beta (dpm) |
|---|---|---|---|
| 1 | Amine/Alcohol | 20,700 | NMA |
| 2 | Amine/Alcohol | 7,000 | NMA |
| 3 | Amine/Alcohol | 19,300 | NMA |
| 4 | Amine/Alcohol | 110,000 | NMA |
| 5 | HCl Only | 11,900 | 8,413 |

NMA no measurable activity

Example 6

Several decontamination solutions were prepared and tested utilizing various acids but containing the same amount of keto-amine (0.5%), isopropyl alcohol (0.3%) and propargyl alcohol (0.3%). Each solution had a pH of 1.2 or below. The solutions were tested on a radioactive contaminated front end loader bucket with each solution being applied at a separate site on the bucket. The solutions were applied as a low pressure spray, allowed to remain at the site for a period of about five minutes and then removed by a squeegee. The spent solution was neutralized to a pH of about 7, using a 50% NaOH solution. Surface contamination levels of both alpha and beta emissions were measured before and after treatment. The results are given in Table 2 as follows:

TABLE 2

| Acid | Alpha (dpm) | Beta (dpm) |
|---|---|---|
| Phosphoric (37%) pH~1 | | |
| Before | 748 | 10,500 |
| After | 350 | 9,030 |
| % Reduction | 50.6% | 14% |

TABLE 2-continued

| Acid | Alpha (dpm) | Beta (dpm) |
|---|---|---|
| Sulfuric (37%) pH~1 | | |
| Before | 748 | 7,088 |
| After | 484 | 6,260 |
| % Reduction | 54.7% | 11.68% |
| Oxalic (10%) pH 1.2 | | |
| Before | 1,030 | 13,000 |
| After | 626 | 12.300 |
| % Reduction | 39.2% | 5.38% |
| Hydrochloric (37%) pH~1 | | |
| Before | 2,640 | 17,400 |
| After | NMA | NMA |
| % Reduction | 100% | 100% |

NMA No Measurable Activity

These results show degrees of effectiveness in removing radioactivity from surfaces utilizing a strong acid combined with a keto-amine and a mixture of lower alcohols, i.e. isopropanol and propargyl alcohol. The results utilizing hydrocholoric acid are clearly superior to the other acids demonstrated but all show the ability to reduce radioactive contamination.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been fully described above with particularity and detail in connection with what is presently deemed to be the most practical and useful embodiments of the invention, it will be apparent to those of ordinary skill in the art that numerous modifications, including, but not limited to, variations in materials, form, function and manner of operation and use may be made, without departing from the principles and concepts of the invention as set forth in the claims.

What is claimed is:

1. A method for removing radioactive contaminants from a surface comprising the steps of:

a) applying to the surface an aqueous acidic solution having a pH of less than 3.0 wherein said aqueous acidic solution comprises a complex substituted keto-amine having a molecular formula of $C_{33}H_{45}NO_2Cl$ H, a mixture of saturated and unsaturated alcohols having 2 to 5 carbon atoms and an acid;

b) retaining said aqueous acidic solution oil said surface for a period of time to allow radioactive contaminants present on said surface to migrate into said aqueous acidic solution; and c) removing the aqueous acidic solution containing said radioactive contaminants from said surface.

2. The method of claim 1, wherein the aqueous acidic solution has a pH of less than about 1.5.

3. The method of claim 1 wherein steps (a), (b) and (c) are repeated to optimize decontamination.

4. The method of claim 1 wherein the aqueous acidic solution containing radioactive contaminants removed in step (c) is neutralized with an alkaline agent to a pH of between 5.5 and 9.0.

5. The method of claim 1 wherein said aqueous acidic solution is applied to said surface by spraying.

6. The method of claim 1 wherein said aqueous acidic solution is retained on said surface for a period of less than ten minutes.

7. The method of claim 1 wherein said surface is a member selected from the group consisting of metal, plastic, glass, concrete, wood, soil and combinations thereof.

8. The method of claim 2, wherein said acid is selected from the group consisting of hydrochloric acid, hydrofluoric acid, sulfuric acid, phosphoric acid, sulfurous acid, bromic acid, iodic acid, nitric acid, perchloric acid, oxalic acid, aqua regia and mixtures thereof.

9. The method of claim 4 wherein said alkaline agent is a member selected from the group consisting of sodium hydroxide and potassium hydroxide.

10. The method of claim 7 wherein said surface is metal.

11. The method of claim 8 wherein each alcohol comprises between 0.1 and 0.5% by weight of the aqueous acidic solution and the complex keto-amine comprises between 0.1 and 2% by weight of the aqueous acidic solution.

12. The method of claim 8, wherein said acid is hydrochloric acid.

13. The method of claim 11, wherein said saturated alcohol is isopropyl alcohol and the unsaturated alcohol is propargyl alcohol.

14. The method of claim 12 wherein the radioactive contaminant is a member of the lanthanide group.

15. The method of claim 12 wherein the radioactive contaminant is a member of the actinide group.

16. The method of claim 12 wherein the radio active contaminant is a member selected from the group consisting of Actinium-227, Americium-241, Americium-243, Antimony-124, Antimony-125, Barium-133, Beryllium-7, Bismuth-207, Cadmium-109, Calcium-45, Carbon-14, Cerium-139, Cerium-141, Cerium-144, Cesium-134, Cesium-135, Cesium-137, Chromium-51, Cobalt-56, Cobalt-57, Cobalt-58, Cobalt-60, Copper-67, Curium-242, Curium-243, Curium-244, Curium-247, Europium-152, Europium-154, Europium-155, Gadolinium-153, Germanium-68, Gold-195, Hafnium-181, Hydrogen-3 (Tritium), Iodine-125, Iodine-126, Iodine-129, Iodine-131, Iodine-133, Iridium-192, Iron-55, Iron-59, Lead-210, Manganese-54, Mercury-203, Neptunium-237, Nickel-59, Nickel-63, Niobium-94, Plutonium-236, Plutonium-238, Plutonium-239, Plutonium-240, Plutonium-241, Plutonium-242, Plutonium-243, Plutonium-244, Polonium-210, Potassium-40, Promethium-1 47, Protactinium-23 1, Radium-223, Radium-224, Radium-226, Radium-228, Ruthenium-106, Samarium-151, Scandium-46, Selenium-75, Silver-108 m, Silver- 110 m, Sodium-22, Strontium-85, Strontium-89, Strontium-90, Sulfur-35, Tanalum-182, Technetium-99, Thallium-204, Thorium-natural, Thorium-228, Thorium-230, Thorium-232, Tin-i 13, Uranium-232, Uranium-233, Uranium-234, Uranium-235, Uranium-236, Uranium-238, Uranium-natural, Uranium-depleted, Yttrium-88, Yttrium-91, Zinc-65, Zirconium-95 and associated decay products thereof.

17. The method of claim 12 wherein said surface is a member selected from the group consisting of metal, plastic, glass, concrete, wood, soil and combinations thereof.

18. The method of claim 12 wherein said surface is a vehicle used for transportation of materials.

19. The method of claim 17 wherein said surface is metal.

* * * * *

UNITED STATES PATENT AND TRADEMARK OFFICE

CERTIFICATE OF CORRECTION

PATENT NO. : 6,497,769 B1
DATED : December 24, 2002
INVENTOR(S) : Robert T. Martin It is certified that error appears in the above-identified patent and that said Letters Patent is hereby corrected as shown below:

Column 1,
Line 66, delete “n”

Column 2,
Line 62, replace “Tanalum” with -- Tantalum --

Column 4,
Line 19, delete “a,” insert -- a -- preceding “strong”

Column 5,
Line 27, delete “that,” insert -- is -- after “required”

Column 7,
Line 12, replace “12.300” with -- 12,300 --
Line 51, replace “oil” with -- on --

Column 8,
Line 50, replace “Tanalum” with -- Tantalum --

Signed and Sealed this

Eleventh Day of March, 2003

JAMES E. ROGAN
*Director of the United States Patent and Trademark Office*